US005327621A

United States Patent [19]

Yasui et al.

[11] Patent Number: 5,327,621

[45] Date of Patent: Jul. 12, 1994

[54] METHOD OF PRODUCING FABRIC REINFORCING MATRIX FOR COMPOSITES

[75] Inventors: Yoshiharu Yasui; Meiji Anahara; Fujio Hori; Junji Takeuchi, all of Kariya, Japan

[73] Assignee: Kabushiki Kaisha Toyoda Jidoshokki Seisakusho, Kariya, Japan

[21] Appl. No.: 34,534

[22] Filed: Mar. 19, 1993

[30] Foreign Application Priority Data

Mar. 23, 1992 [JP] Japan ..... 4-065158
Mar. 23, 1992 [JP] Japan ..... 4-065159

[51] Int. Cl.[5] ..... D03D 13/00

[52] U.S. Cl. ..... 28/149; 139/11; 139/DIG. 1; 139/430; 28/151; 428/225; 428/257

[58] Field of Search ..... 428/225, 257; 139/430, 139/DIG. 1, 384 R, 34, 11; 112/80.1; 156/393, 148, 163, 164; 28/140, 149, 151

[56] References Cited

U.S. PATENT DOCUMENTS 4,725,485 2/1988 Hirokawa ..... 139/DIG. 1 X
5,121,530 6/1992 Sakatami et al. ..... 28/140 X
5,211,967 5/1993 Yasui et al. ..... 139/DIG. 1 X
5,224,519 7/1993 Farley ..... 139/DIG. 1 X

FOREIGN PATENT DOCUMENTS 61-30059 7/1986 Japan .
63-42955 2/1988 Japan .

*Primary Examiner*—Andrew M. Falik
*Attorney, Agent, or Firm*—Brooks Haidt Haffner & Delahunty

[57] ABSTRACT

A reinforcing matrix is produced using a plurality of regulating members (pins) removably arranged in rows in a predetermined direction on a base. Yarns are woven between the pins on the base repeatedly looping back and forth between spaced apart positions to form a yarn lamination consisting of a plurality of yarn layers over the base. The yarns forming the yarn layers are arranged in at least two directions. Thereafter the yarn lamination is removed from the base together with the pins. Then the pins are replaced sequentially in rows arranged in the predetermined direction with separate vertical yarns which are inserted into the yarn lamination so as to form loops. A selvage thread is inserted in the predetermined direction through the loops of the vertical yarns.

9 Claims, 15 Drawing Sheets

METHOD OF PRODUCING FABRIC REINFORCING MATRIX FOR COMPOSITES

BACKGROUND OF THE INVENTION

1. Field of the Invention

The present invention relates generally to three dimensional fabrics, and more particularly, it relates to a method of producing a fabric reinforcing matrix for composites.

2. Description of the Related Art

Fabric reinforcing composites are commonly used as light structural materials. A three-dimensional fabric is conventionally used as a reinforcing matrix for a composite. A three-dimensional fabric generally includes three kinds of threads or yarns respectively extending along the X, Y and Z directions. Composites having such a three-dimensional fabric as a frame member, are expected to be widely used as structural materials for rockets, aircraft, automobiles, marine vessels and buildings. The frame member is impregnated with a resin or other inorganic substances. The use of five-axis three-dimensional fabrics, having yarns that are angularly arranged with respect to the longitudinal direction, is proposed. These yarns are provided in addition to the yarns extending along the X, Y and Z directions.

An exemplary method of producing a three-dimensional fiber structure is to laminate a plurality of yarn layers, each formed by arranging lines of yarn repeatedly looped back at both ends, and to interconnect these yarn layers by the lines of yarn running in the thickness (vertical) direction. Such a method is disclosed in Japanese Unexamined Patent Publication No. Sho 63-42955. As shown in FIG. 29, of the present application, this Japanese publication describes apparatus that utilizes a plurality of yarn guide pipes 32 that are placed upright at predetermined pitches on a base plate 31.

Plate-like separators 33 are placed in parallel between the yarn guide pipes 32. A plate-like spacer 34 lies on, and extends perpendicularly to the separators 33. The lines of the first endless yarn Y1 are looped back and engage with the yarn guide pipes 32 located at the peripheral portions of the base plate 31. The lines of the first endless yarn Y1 also weave between the yarn guide pipes 32 in a direction perpendicular to the direction of the arrangement of the spacer 34, yielding a yarn layer.

The lines of the first endless yarn Y1 are arranged on the yarn layer and are looped back in a direction perpendicular to the direction of arrangement of the first endless yarn. The arrangement of the first endless yarn Y1 is repeated in the same manner to provide a lamination of a predetermined number of yarn layers, thus yielding a yarn lamination. Next, a spacer 34 is placed on the yarn lamination in the same manner as described above. The yarn lamination is then tightened by the spacers 34 from the top and bottom directions. Then, the yarn guide pipes 32 are replaced with the lines of the second endless yarn Y2, for completing a reinforcing matrix for the composite.

The yarn guide pipes 32 are replaced with the lines of the second endless yarn Y2 in the following manner. First, the separators 33 are removed in order, and the yarn guide pipes 32 are pulled up in succession to the vicinity of the lower spacer 34. Then, the second endless yarn Y2 is bent in a loop (L), and is hooked on a yarn guide 35, which in turn, is inserted into the associated yarn guide pipe 32. Then, the yarn guide pipe 32 is pulled up so that the loop L comes out on the top of the lamination of the first endless yarn Y1. In this condition, the loop L is removed from the yarn guide pipe 32 and the third endless yarn Y3 is inserted as a tacking yarn through the loop L. Then, the second endless yarn Y2 is pulled down to tighten the yarn lamination. The foregoing steps are repeated each of the yarn guide pipes 32, to complete the replacement of the yarn guide pipes 32 with the lines of the second endless yarn Y2.

In the above method, the yarn lamination is tightened by the cooperation of the lines of the second endless yarn Y2 for coupling the yarn lamination, and the lines of the third endless yarn Y3, which are inserted through the loops L of the endless yarn Y2. The direction of arrangement of the lines of the second endless yarn Y2 on the opposite surface of the yarn lamination to the one where the lines of the third endless yarn Y3 are arranged, is the same as the direction of arrangement of the third endless yarn Y3.

Accordingly, the yarn lamination is firmly tightened at those portions where the lines of the second endless yarn Y2 face the lines of the third endless yarn Y3. As a result, the portions between the tightened portions will rise, causing the yarn lamination to undulate. In other words, the yarn lamination does not have a uniform thickness. This not only causes a periodic variation in the fabric filling factor, but also shortens the length of the reinforcing matrix along the direction perpendicular to the direction of arrangement of the lines of the third endless yarn Y3. Therefore, the intended three-dimensional fiber structure will not be obtained.

In impregnating such a three-dimensional fiber structure with resin, if this structure were not simultaneously pressed and stretched in the direction perpendicular to the undulation, the variation in the fabric filling factor is transmitted directly to the composite and the final product.

In order to provide a large reinforcing matrix, more than ten thousand yarn guide pipes 32 might be needed. Consequently, it would be difficult to replace the yarn guide pipes 32 one by one, with a single second endless yarn Y2.

Further, in the above method, the yarn guide pipes 32 serve as means through which the lines of the second endless yarn Y2 are inserted, and the second endless yarn Y2 is inserted into the yarn lamination at the same time as the associated yarn guide pipe 32 is removed. This method however requires that the yarn guide pipes 32 be pulled from the opposite side to the inserting side of the yarn guide 35. This will not cause any problem when the reinforcing matrix for composite is of a flat type, but will be inconvenient when the reinforcing matrix is U shaped, box shaped, or with narrow spaces between the opposite faces. This is because when the yarn guide pipe 32 is driven out from one side toward the opposite side, the yarn guide pipe 32 might encounter the opposite surface and might not be removed. Further, in pulling the yarn guide pipe 32 in the direction away from the opposite surface, it would be troublesome to insert the yarn guide 35 with the second endless yarn Y2 hooked thereon, into the associated yarn guide pipe 32.

Japanese Patent Publication Sho 61-30059 discloses a method of sewing a plurality of laminations of two-dimensional yarn layers with a sewing machine to produce a three-dimensional fiber structure. The sewing machine used in this method is equipped with an auxiliary needle 37 in addition to a sewing needle 36, as shown in FIG. 30 at the present application. The lamination of yarn layers 38 is stitched with a sewing yarn 39 and a shuttle yarn 40. The auxiliary needle 37 pierces the yarn layers 38 before the sewing needle 36, to facilitate the insertion of the sewing needle 36.

As the plurality of laminations of two-dimensional yarn layers are sewn together using the sewing machine, it is unnecessary to replace yarn guide pipes or pins with the coupling yarn. The fabric materials that are used in a reinforcing matrix are glass fiber, carbon fiber, ceramic fiber and the like, which do not stretch very much, and which are generally fragile. At the time the auxiliary needle 37 pierces the dense fiber structure, the needle 37 is likely to damage part of the fiber stricture. In addition, it is difficult to secure sufficient space for the sewing needle 36 with the sewing yarn 39 inserted through its eye, to be smoothly inserted into the space formed by the auxiliary needle 37. Thus, when the sewing needle 36 pierces the fiber structure, it is likely to damage the fiber structure again.

Another method of producing a three-dimensional fabric has also been used. In this method, the yarn is placed between regulating members (pins) arranged at predetermined pitches on the base, and is looped back at the edges of the base, forming a lamination. The pans are replaced with vertical yarns using replacing members which hold coupling yarns (vertical yarns). In this case, the pins and the yarn lamination are removed from the base before the replacement operation. Then, the replacing member is placed on the associated pin and is pressed to drive out the pin and, at the same time, to insert the vertical yarn into the space formed by the pin. When the pins are removed from the base, however, both ends of each pin become free, so that the pins could tilt under the pressure of the laminated yarn layers. At this time, positions of the tips of the pins are not stable, thus making it difficult to mechanically abut the replacing members on the pins. It is therefore difficult to perform automatic replacement with a machine without misplacement of the vertical yarn.

SUMMARY OF THE INVENTION

Accordingly, it is a primary objective of the present invention to provide a method of producing a reinforcing matrix for a composite, which allows the yarn holding a lamination from both the front and back sides, to significantly reduce periodic lifting of the yarn lamination, thereby enhancing the fiber filling factor, and preventing a variation in the vertical and longitudinal dimensions.

It is another objective of the present invention to provide a method of producing a reinforcing matrix for a composite, which allows vertical yarns to be easily and securely inserted into spaces formed by regulating members or pins, for interconnecting the yarn layers.

To achieve the first objective, a reinforcing matrix for a composite according to the present invention uses a base on which a number of pins project upwardly, and are removably provided upright, in a plurality of rows, at predetermined pitches, along one predetermined direction. The reinforcing matrix is produced by the following methods:

(1) Weave yarns between the pins on the base, while repeatedly looping back at proper positions, to form a yarn lamination consisting of a plurality of yarn layers along the surface of the base. The yarns form yarn layers arranged in at least two directions.

(2) Remove the yarn lamination, formed on the base, together with the pins from the base.

(3) Sequentially replace the regulating members, arranged in a predetermined direction relative to the yarn lamination, with separate vertical yarns, which are inserted into the yarn lamination, and which form corresponding loops.

(4) Insert a selvage thread to be arranged in the predetermined direction of the yarn lamination into the loops of the vertical yarns.

The selvage thread is arranged in a predetermined direction of the yarn lamination, while the vertical yarns are arranged on the top surface of the yarn lamination in the direction perpendicular to the predetermined direction of the yarn lamination. Therefore, the vertical yarns and the selvage thread press the yarn lamination in the mutually perpendicular directions from both the front and back sides of the yarn lamination. This will prevent both the front and back surfaces of the yarn lamination from periodically expanding. It is therefore possible to enhance the fiber filling factor and to prevent variation of the vertical and longitudinal dimensions.

To achieve the second objective, a reinforcing matrix is provided in which, in the aforementioned step of sequentially replacing the plurality of regulating members with vertical yarns, the pins are removed from the yarn lamination and the vertical yarns are inserted, each in a loop, into spaces formed by the pins, using yarn inserting members.

The spaces are formed by the pins at predetermined positions in association with the position of arrangement of the yarn lamination. Therefore, the step of positioning the yarn inserting members in the spaces is relatively easier than the step of abutting the yarn inserting members on the tips of the pins. The spaces formed by the removal of the pins are equal to, or slightly smaller than the diameter of the pins. This allows the yarn inserting members to be placed into the yarn lamination with slight contact therewith, so that the pins can be replaced with the vertical yarns without causing significant damage to the yarn lamination.

If the replacement of the pins with the vertical yarns is carried out according to the following two steps, a plurality of pins can be simultaneously replaced with vertical yarns, thus improving productivity:

(1) With the vertical yarns retained by the yarn inserting members corresponding in number to the pins which are arranged in one predetermined direction of the yarn lamination, the yarn inserting members are replaced with the pins, and the regulating members are simultaneously inserted into the lamination, until those portions of the yarn inserting members that are holding the vertical yarns come out of the yarn lamination.

(2) A selvage thread is inserted into the loops of the respective vertical yarns held by the yarn inserting members, in the direction of arrangement of the yarn inserting members, and then the yarn inserting members are pulled back to their original positions.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings, in which:

DETAILED DESCRIPTION OF THE PREFERRED EMBODIMENTS

First Embodiment

A first embodiment of the present invention includes a method for producing a flat reinforcing matrix for a composite, and will now be described referring to FIGS. 1 through 17.

Figure 1:
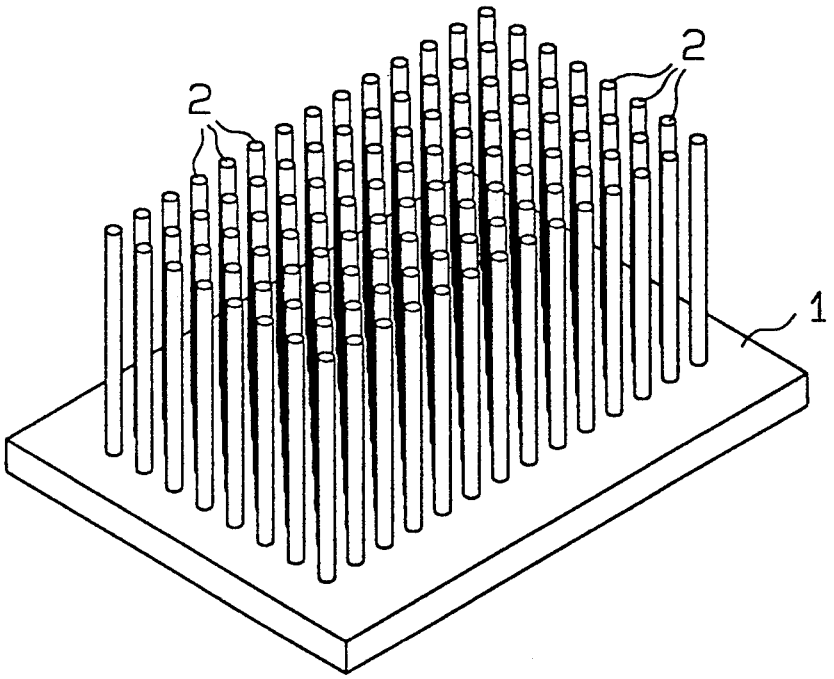
FIG. 1 is a schematic perspective view showing a base used in producing a reinforcing matrix for a composite, according to a first embodiment of the present invention.

FIG. 1 shows a flat base 1, used in producing a reinforcing matrix. A plurality of pins 2 extend upwardly from one side of the base 1. The ping are disposed in a plurality of rows, that are placed at predetermined pitches along the width of the base 1. The pins 2 serve as regulating members to regulate the arrangement of the yarns. A plurality of support plates 3 are disposed on the base 1, between the pins 2. On the support plates 3, a first yarn or weft x is arranged in a first plane; a second yarn or warp y is arranged in a second planes a first bias yarn $B_1$ and a second bias yarn $B_2$ are woven between the pins 2, and are repeatedly looped back and forth in engagement with the outer surfaces of the pine 2 which are located at the peripheral edges of the base 1, as shown in FIGS. 3 to 6. The weft layer x, warp layer y and bias-yarn layers $B_1$ and $B_2$ are laminated in a predetermined order.

Figure 3:
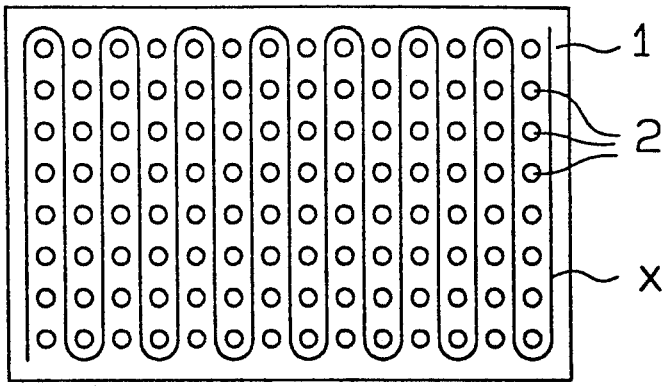
FIG. 3 is a schematic plan view showing how a first yarn or weft (arranged in a first plane) is arranged on the base of FIG. 1.
Figure 4:
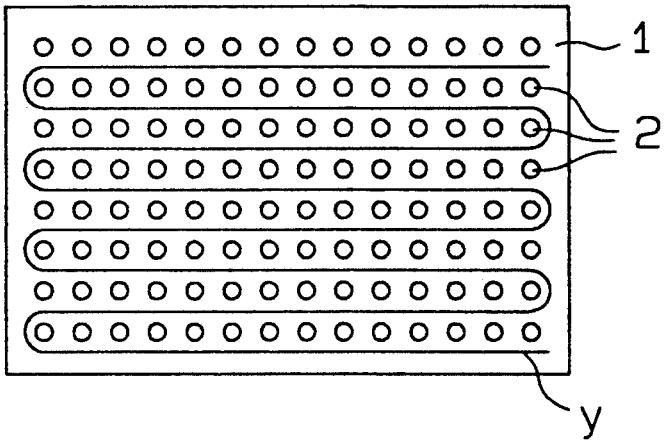
FIG. 4 is a schematic plan view showing how a second yarn or warp (arranged in a second plane) is arranged on the base of FIG. 1.
Figure 5:
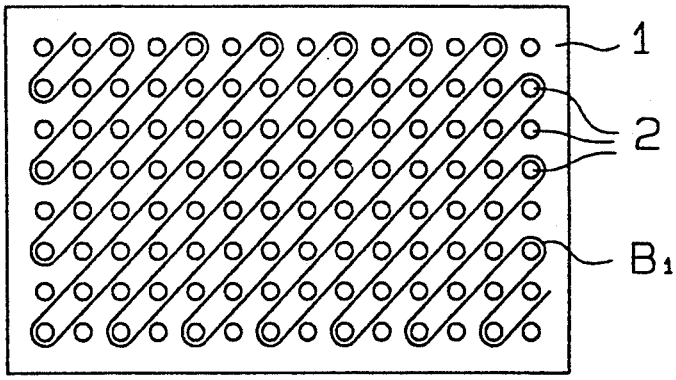
FIG. 5 is a schematic plan view showing how a first bias yarn is arranged on the base in FIG. 1.
Figure 6:
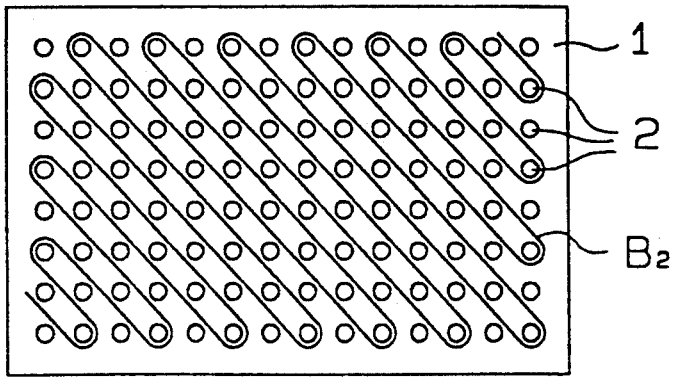
FIG. 6 is a schematic plan view showing how a second bias yarn is arranged on the base in FIG. 1.

As shorn in FIG. 3, the lines of the weft x are arranged in parallel, along the width of the base 1, and are repeatedly looped back and forth around the pins 2 located at the corresponding opposite ends of the base 1. As shown in FIG. 4, the lines of the warp y are arranged in parallel along the length of the base 1, and are repeatedly looped back and forth around the pins 2 located at the corresponding opposite ends of the base 1. The lines of the first bias yarn $B_1$, which form the first layer of a pair of bias-yarn layers, are arranged at an angle of $+45°$ with respect to the length of the base 1, and are looped back and forth around the pins 2 located along the edges of the base 1, as shown in FIG. 5. The lines of the second bias yarn $B_2$, which form the second layer of the bias-yarn layers, are arranged at an angle of $-45°$ with respect to the length of the base 1, and are looped back and forth around the pins 2 located along the edges of the base 1, as shown in FIG. 6. Various fiber materials, such as carbon fiber, ceramic fiber, glass fiber, and aramid fiber, could be used for each yarn.

Figure 2:
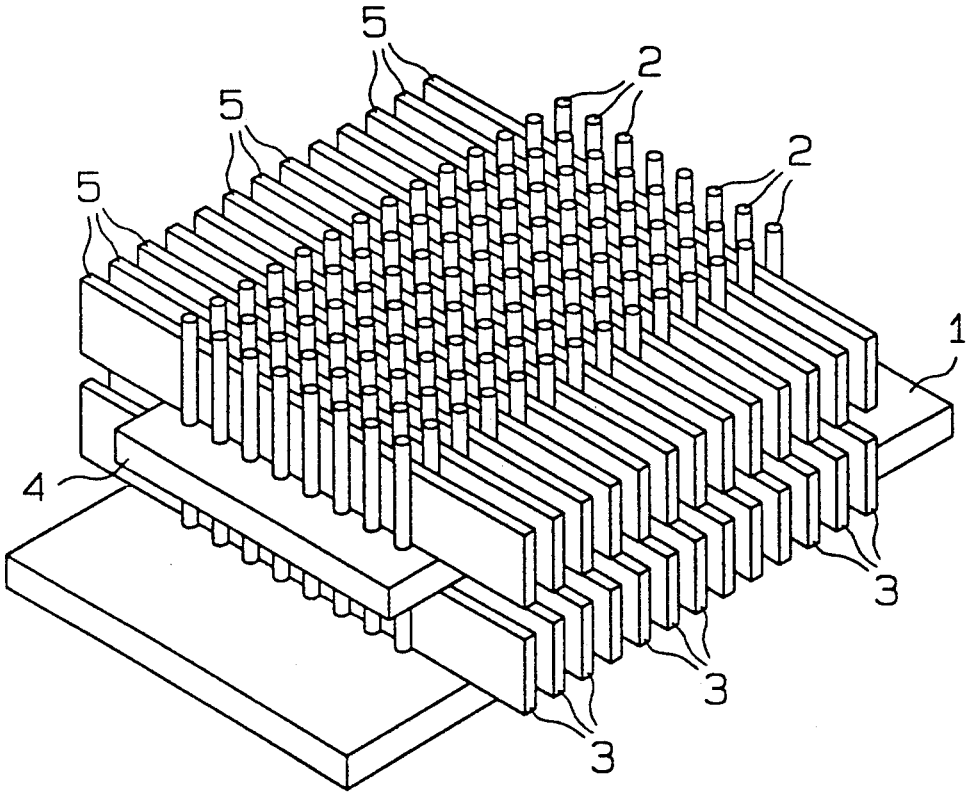
FIG. 2 is a schematic perspective view illustrating the arrangement of a plurality of support plates, a yarn lamination, and a plurality of pressure plates on the base shown in FIG. 1.

After the individual yarn layers are laminated on the base 1 in a predetermined order, to form a yarn lamination 4, a compressive force is applied thereon, to increase the density of the fibers of the yarn lamination 4, and to adjust the thickness thereof. More specifically, pressure plates 5 are arranged in parallel on the lamination 4 in association with the support plates 3, so that the lamination 4 is compressed by the support plates 3 and the pressure plates 5, as shown in FIG. 2. It is preferable that this compression be performed, not only when the arrangements of the weft x, warp y and the first and second bias yarns $B_1$ and $B_2$ are all completed, but also periodically, while arranging those yarns. This will decrease the variation in the fiber density, and increase the fiber density.

Next, the lamination 4 and the pins 2 are separated from the bass 1. The support plates 3 facilitate the separation of the pins 2 and the layer lamination 4 from the base 1. It is preferable that the weft x, warp y and both bias yarns $B_1$ and $B_2$ be arranged in a mirror symmetric fashion with respect to an imaginary plane at the center of the lamination 4, in the thickness or vertical direction, in order to prevent the reinforcing matrix from deforming after being impregnated with a resin.

The pins 2 are still placed into the lamination 4 after the separation from the base 1, and are replaced with vertical yarns z, such that the laminated layers are interconnected with the vertical yarns z. Unlike the prior art, one row of pins 2 arranged along the width of the lamination 4 are replaced with vertical yarns z simultaneously.

Figure 7:
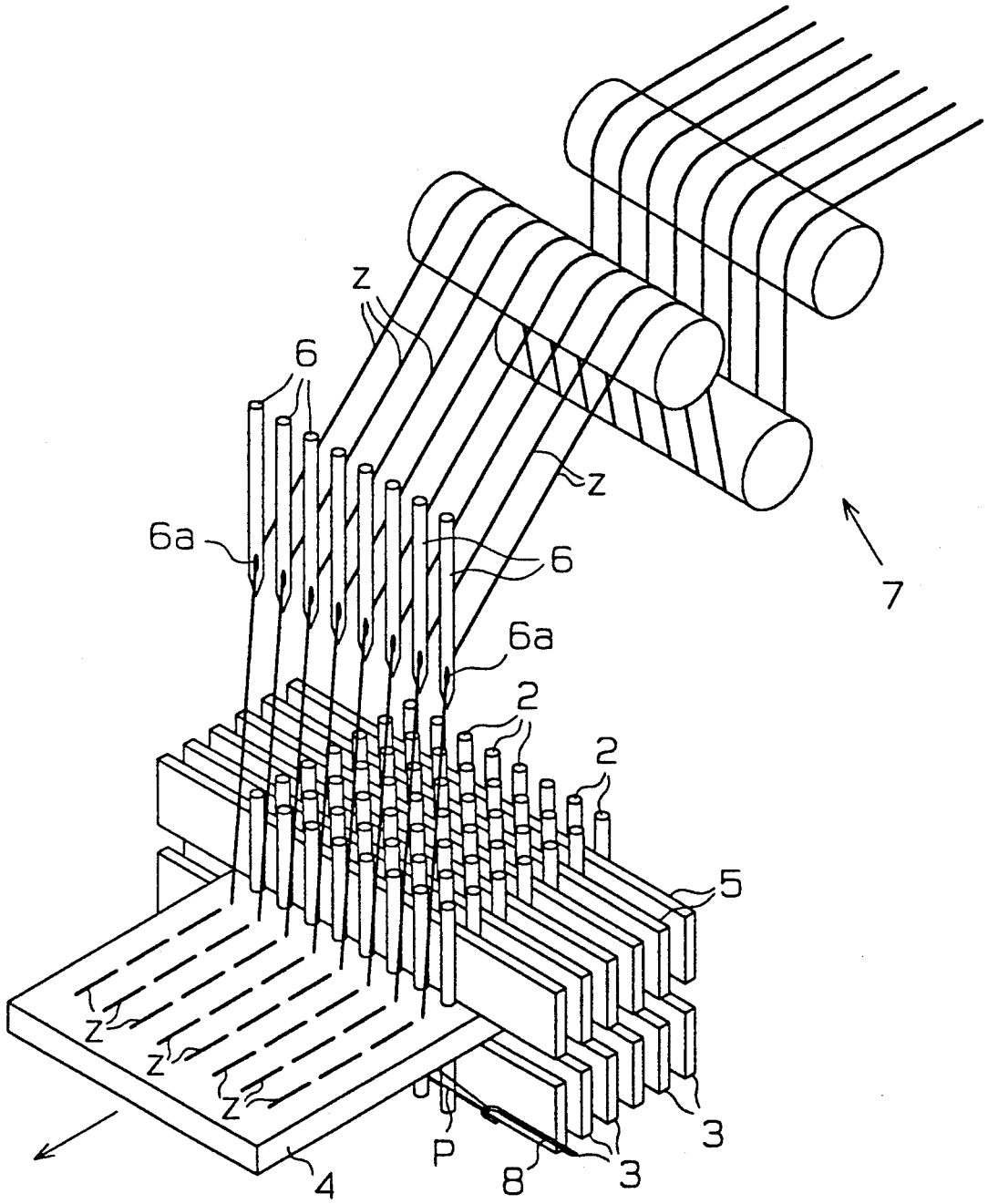
FIG. 7 is a schematic perspective view showing the positional relationship between the yarn lamination, and a first set of needles, when a plurality of pins are replaced with vertical yarns.

As shown in FIG. 7, a first set of needles 6 serves as yarn inserting members. The number of needles 6 is equal to the number of pans 2 arranged along the width direction of the lamination 4. The needles 6 are disposed at the same pitches as the pins 2. The first set of needles 6 have substantially the same diameter as that of the pins 2. The first set of needles 6 are arranged to be simultaneously moved up and down by a lifting mechanism (not shown). The vertical yarns z are fed out from a vertical-yarn feeding section (not shown). A tension adjuster 7 is provided between the vertical-yarn feeding section and the first set of needles 6, to absorb the slack of each vertical yarn z, and to apply tension to the yarn z.

The lamination 4 is supported by a supporting device (not shown) while being held by the support plates 3 and pressure plates 5. The supporting device can move the lamination 4 along a direction perpendicular to the direction of arrangement of the first set of needles 6. As one row of pine 2 is replaced with the vertical yarns z, the lamination 4 is moved in the direction of the arrow shown in FIG. 7, so that the next row of pins 2 face the first set of needles 6.

The replacement of the pins 2 with the vertical yarns z will be described in more detail referring to FIGS. 8 through 16. For convenience, the number of pins 2 and first set of needles 6 has been reduced, and the support plates 3 and pressure plates 5 have not been illustrated.

Figure 8:
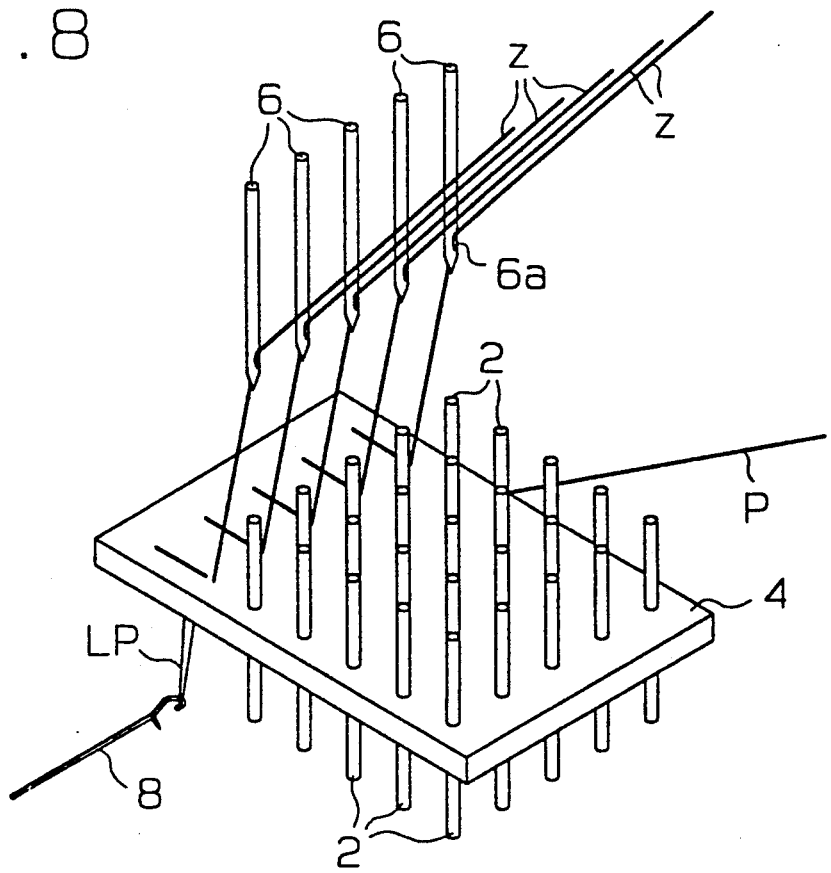
FIG. 8 is a schematic perspective view illustrating the set of first needles at positions corresponding to a second row of the pins.
Figure 9:
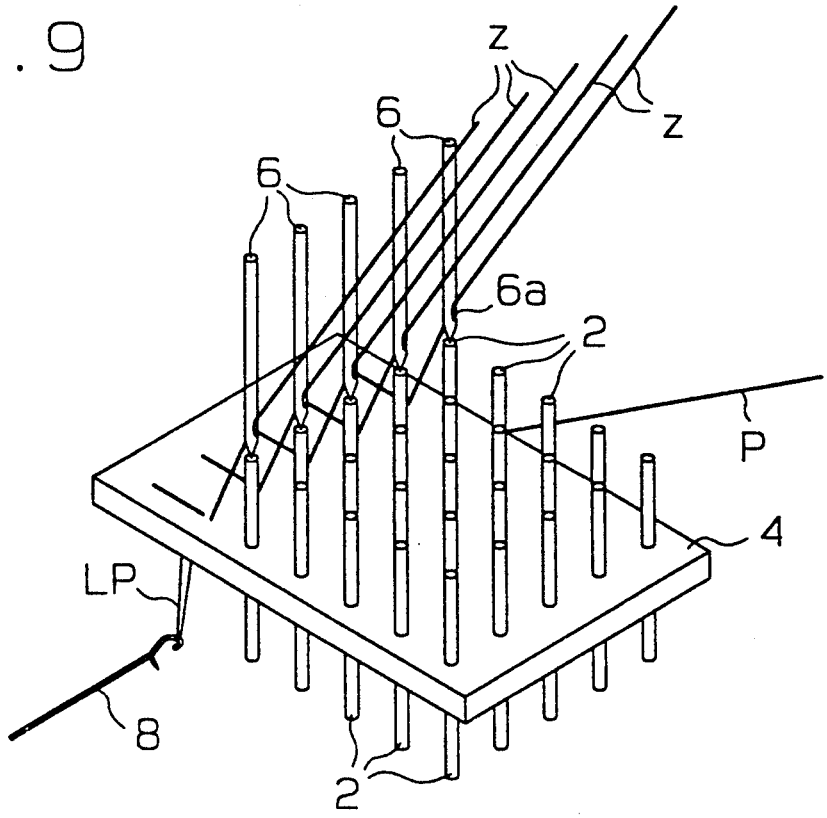
FIG. 9 is a schematic perspective view illustrating the first set of needles abutting the pins.
Figure 10:
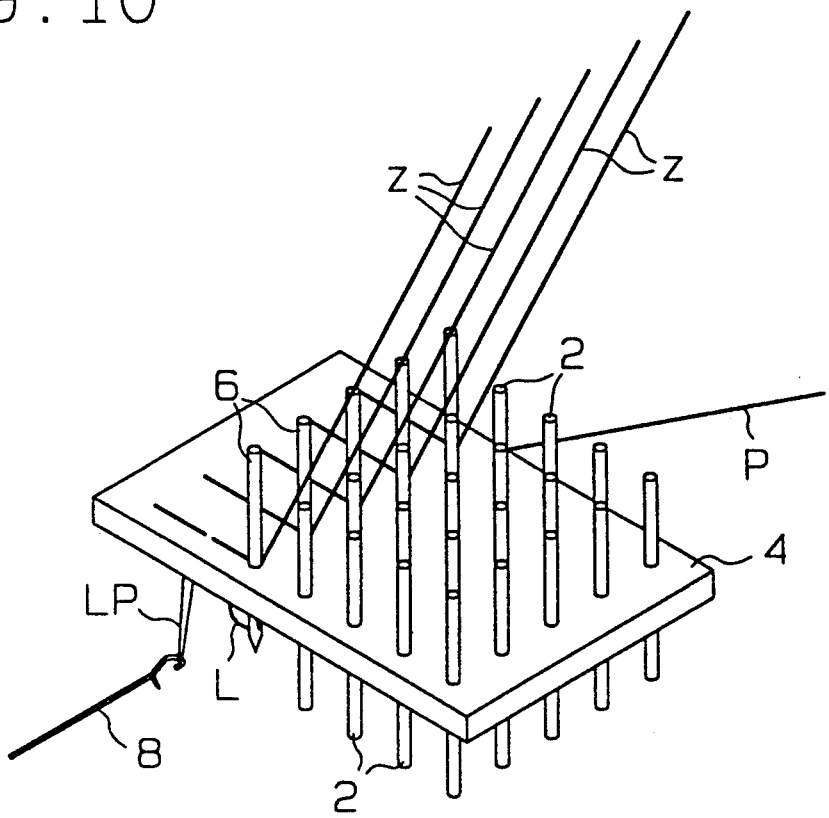
FIG. 10 is a schematic perspective view showing the first set of needles inserted into the yarn lamination.

FIG. 8 illustrates the lamination 4 after replacement of two rows of pins 2 with the vertical yarns z. As illustrated in FIG. 9, the first set of needles 6 are simultaneously moved down, with their tips abutting the top portions of the pins 2. The first set of needles 6 are moved further down into the lamination 4, until eyes 6*a* holding the vertical yarns z come out on the bottom of the lamination 4 (see FIGS. 10 and 14). As a result, the pins 2 corresponding to the first set of needles 6 are driven out and the vertical yarns z are collectively inserted into the drive out spaces of the pins 2. Each vertical yarn forms a loop (L) .

Figure 11:
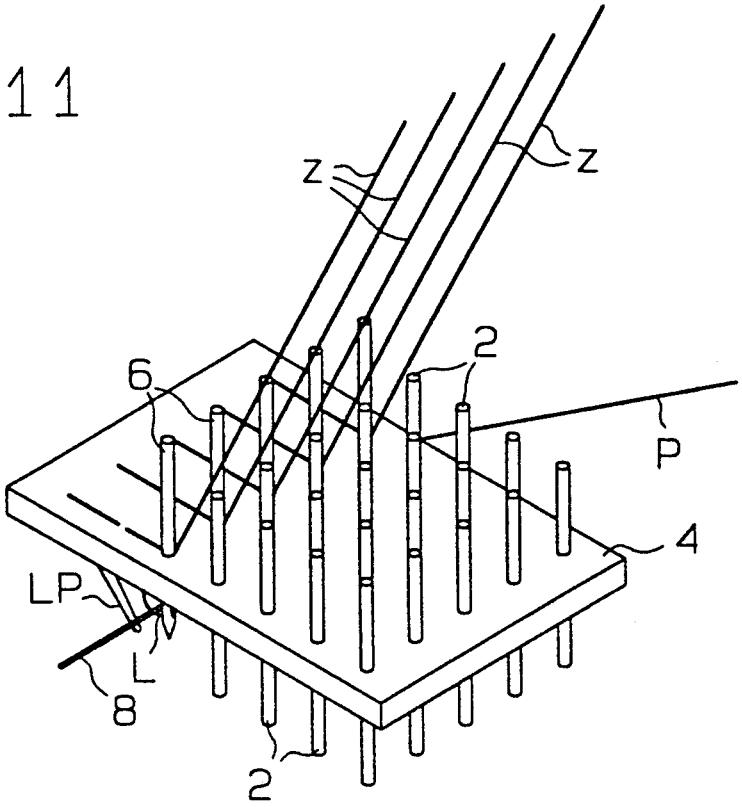
FIG. 11 is a schematic perspective view showing a second needle inserted through the loops of the vertical yarns.
Figure 12:
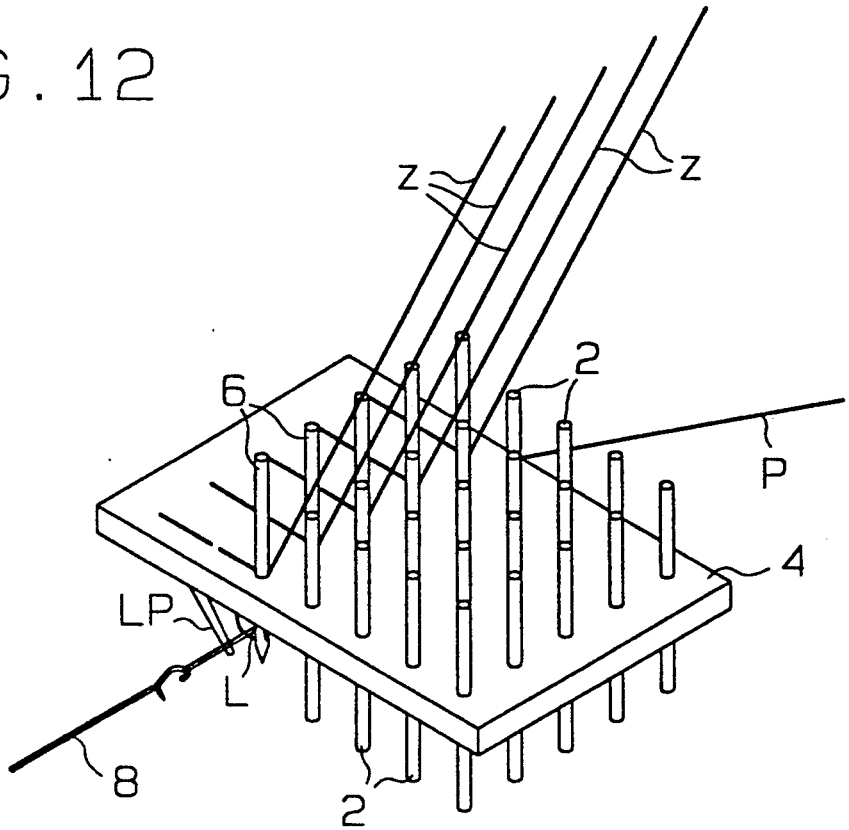
FIG. 12 is a schematic perspective view showing a selvage thread inserted through the loops of the vertical yarns.
Figure 13:
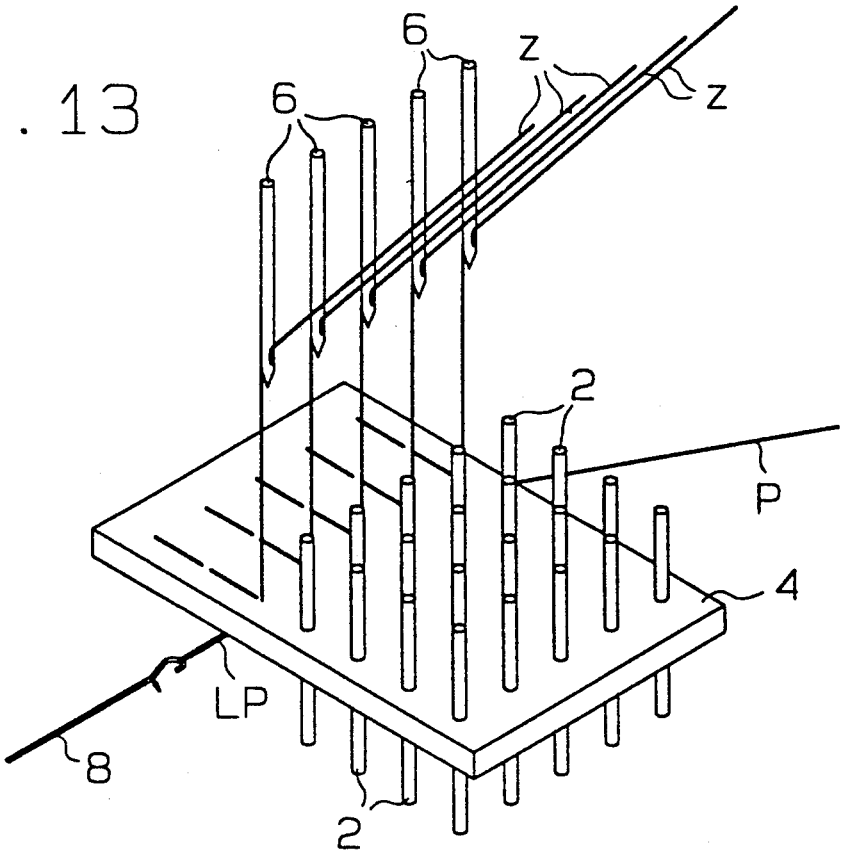
FIG. 13 is a schematic perspective view illustrating the first set of needles pulled back to the original positions.
Figure 14:
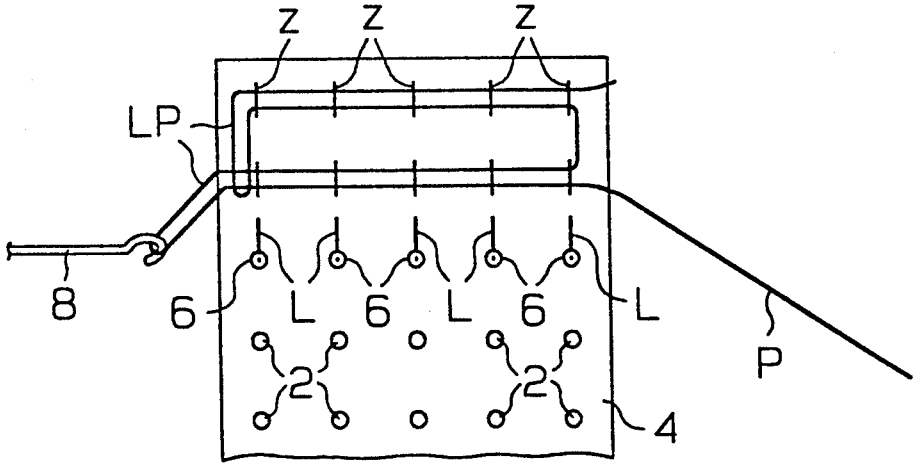
FIG. 14 is a schematic bottom view of the lamination, corresponding to FIG. 10.
Figure 15:
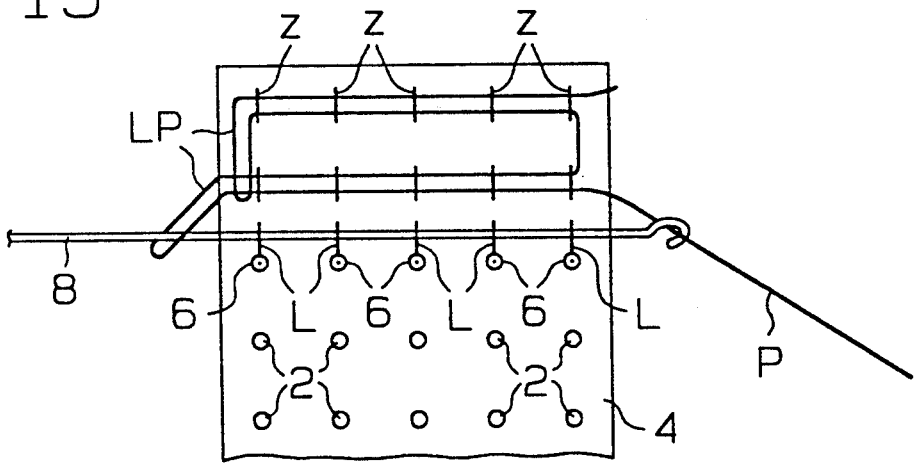
FIG. 15 is a schematic bottom view of the lamination, corresponding to FIG. 11.

Next, as shown in FIG. 11, a second needle 8 is inserted through a loop LP of a lacking a selvage thread P that has previously been inserted in a single pass through the loops L of the vertical yarns z, and is moved forward in the direction of arrangement of the first set of needles 6. The tip of the second needle 8 sequentially passes through the loops L of the individual vertical yarns z, held by the respective first set of needles 6, and the second needle 8 stops when its tip reaches the edge of the lamination 4. At this time, the selvage thread P, fed out from a selvage-thread feeding section, comes in engagement with the tip of the second needle 8 ( see FIG. 15 ).

Figure 16:
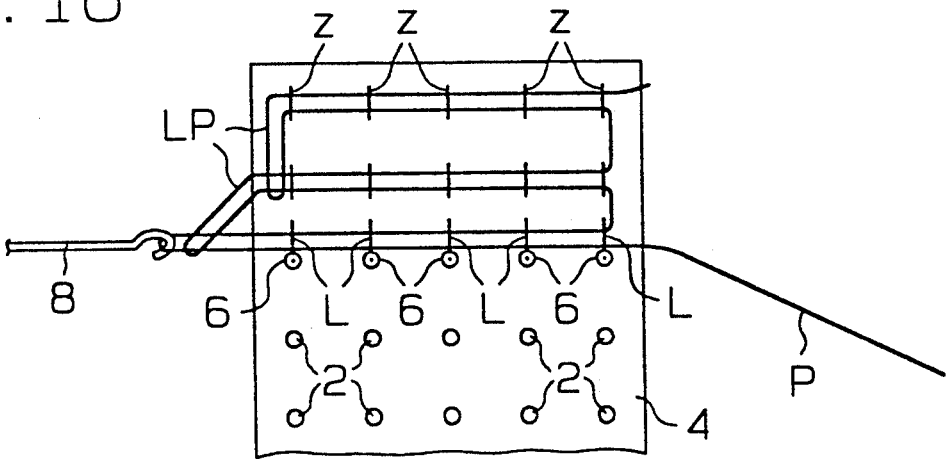
FIG. 16 is a schematic bottom view of the lamination, corresponding to FIG. 12.

A latch (not shown) of the second needle 8, disposed at the distal end thereof, is closed to prevent the loop L from being pulling back. The second needle 8 is then pulled back so that the selvage thread P is inserted, in a loop (LP), through the loops L of the vertical yarns z, as shown in FIG. 16. The loop LP of the selvage thread P is held through the loop LP of the previous selvage thread P (see FIG. 12 ). Then, the first set of needles 6 is lifted up out of the lamination 4 to its original position. The vertical yarns z are pulled by the action of the tension adjuster 7 so as to tighten the vertical yarns z, which are retained by the selvage thread P (see FIG. 13).

The yarn lamination 4 is then moved to where the next row of pins 2 face the corresponding first act of needles 6. Then, one support plate 3 and one pressure plate 5 are removed, and the foregoing steps are repeated. In this manner, the pins 2 are sequentially replaced row by raw with the vertical yarns z. Accordingly, the individual yarn layers, which form the lamination 4, are interconnected by the vertical yarns z, thus yielding a reinforcing matrix.

As mentioned earlier, the selvage thread P is arranged along the width direction of the lamination 4, while the vertical yarns z are arranged on the front side of the lamination 4, along a direction that is perpendicular to the direction of arrangement of the selvage thread P. Therefore, the vertical yarns z and the selvage thread P press the lamination 4 along two perpendicular directions, from the front and back sides of the lamination 4. Contrary to the case where the vertical yarns z and the selvage thread P are arranged in the same direction, both the front and back sides of the lamination 4 are prevented from developing periodic undulation extending in the same direction. Therefore, the fiber filling factor becomes uniform and increases. In addition, a variation of the width dimension of the yarn lamination 4 can be prevented. In impregnating the reinforcing matrix with a resin, therefore, uniform products composed of the matrix and the resin will be acquired without pressing the reinforcing matrix while stretching it.

Figure 17:
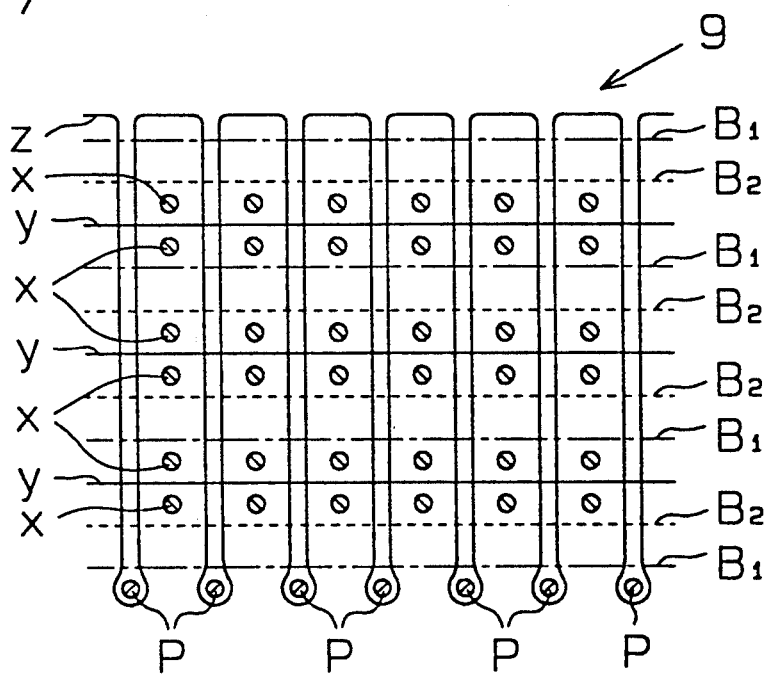
FIG. 17 is an exemplary cross sectional view of a reinforcing matrix.

The direction of arrangement of the vertical yarns z on the top surface of the lamination 4 differs from that of the selvage thread P. As shown in FIG. 17, the reinforcing matrix 9 is not symmetrical with respect to an imaginary plans passing through the center of the reinforcing matrix 9 in the thickness direction. Normally, the number of the vertical yarns z and the selvage thread P, including those present in the thickness (vertical) direction of the reinforcing matrix, as well as those on the top and bottom surfaces thereof, is about 10% or less of the total amount of fibers that constitute the reinforcing matrix. The asymmetry of the arrangement of the vertical yarns z and selvage thread P will not therefore cause "deformation" after impregnation with a resin.

In addition, since, unlike in the prior art, the rows of pins 2 are replaced with the vertical yarns z, one row at a time, the production efficiency of the reinforcing matrix is improved.

Second Embodiment

Figure 18:
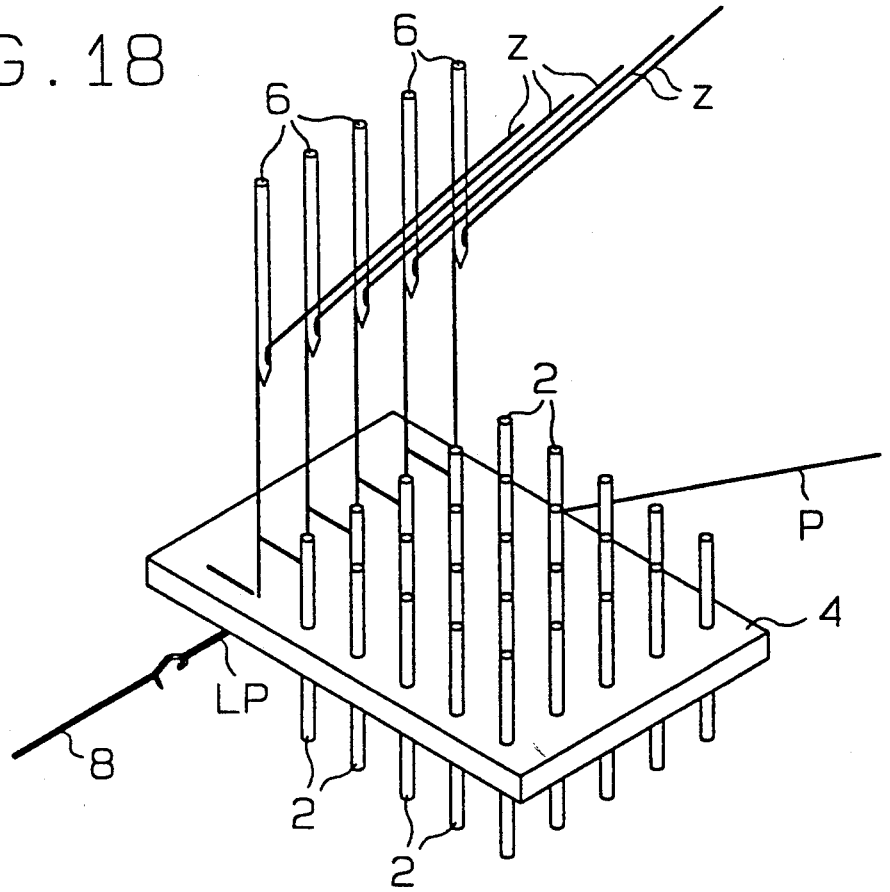
FIG. 18 is a schematic perspective view after the replacement of a second row of pins with vertical yarns, has been completed, according to a second embodiment of the present invention.

A second embodiment will now be described referring to FIGS. 18 to 20.

The method of producing a reinforcing matrix according to this embodiment is similar to that of the first embodiment up to the formation of the lamination 4. However, the step of replacing the pins 2 with the vertical yarns z, following the formation of the lamination 4 differs from that in the first embodiment. FIG. 18 illustrates the lamination 4 with two rows of pins 2 replaced with the vertical yarns z. Although not shown, the next row of pans 2 are pulled upward out of the lamination 4, without using the first set of needles 6, but with a Din removing device (not shown). If the vertical yarns z extending from the tension adjuster 7 to the first set of needles 6 interfere with the pins 2, hindering the pin extraction, the pin extraction is performed after the lamination 4 is moved to where the obstruction does not occur. The materials for the individual yarns which constitute the lamination 4 are made of fibers with small extensibility, such as glass fiber, carbon fiber and ceramic fiber. The individual yarns remain at the previous positions for a while, even after the pine 2 are pulled out. Thus, the spaces formed in the lamination 4 by the extraction of the pins 2 therefrom, are almost equal to, or slightly smaller than the outside diameters of the pins 2.

Figure 19:
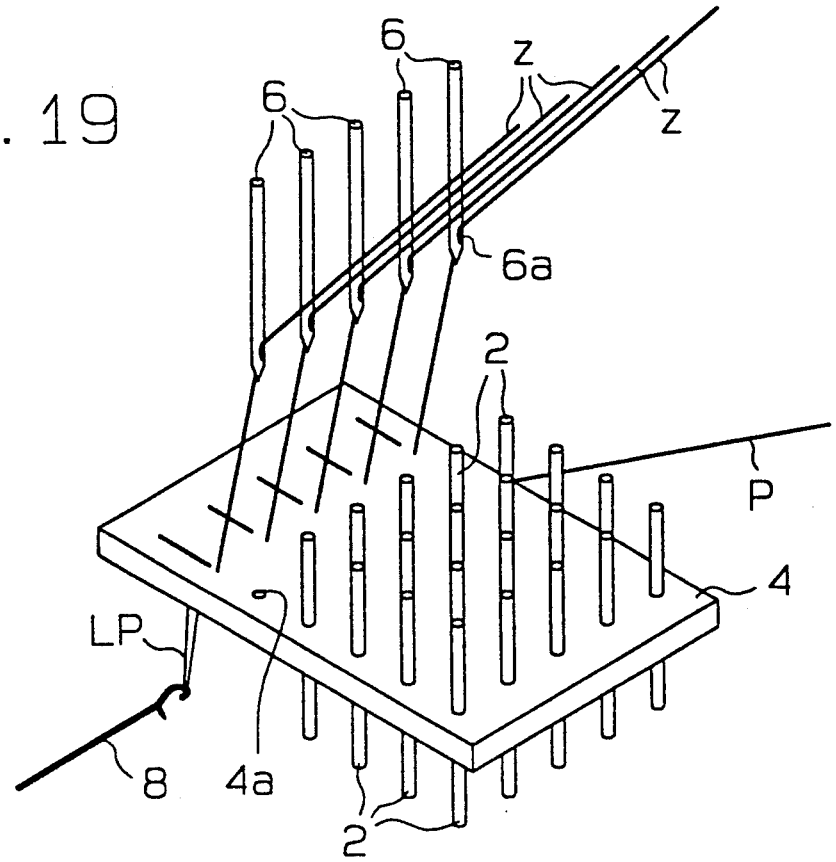
FIG. 19 is a schematic perspective view of the yarn lamination, after a third row of pins have been removed.
Figure 20:
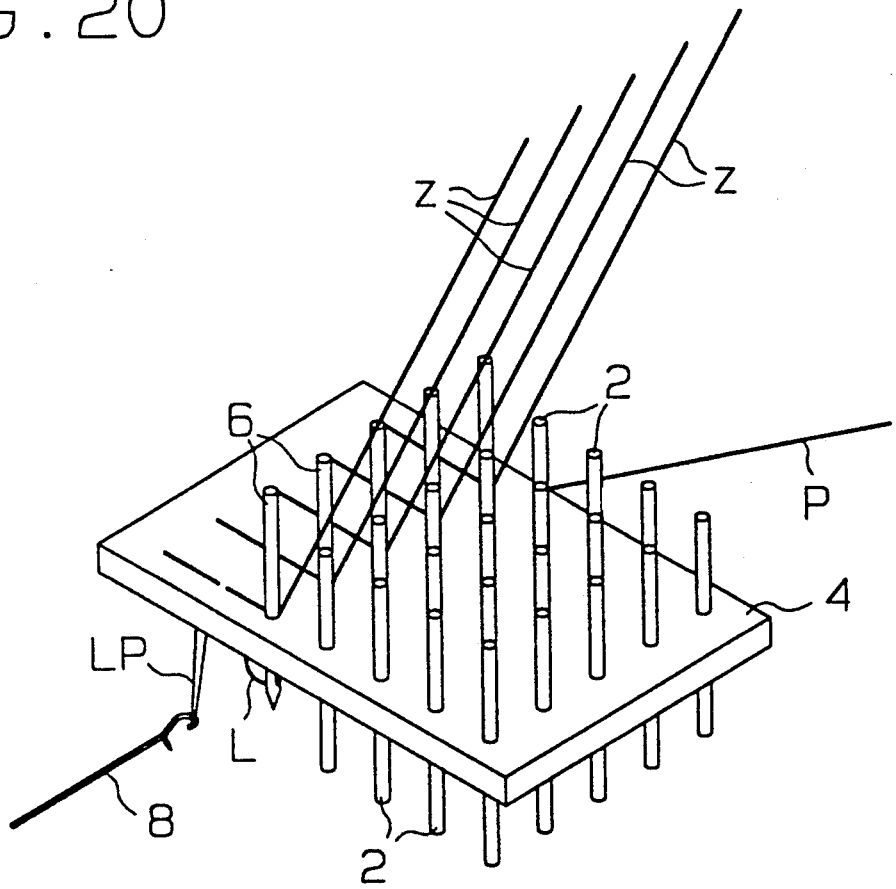
FIG. 20 is a schematic perspective view showing the first needles inserted into the yarn lamination.

Next, the lamination 4 is moved, so that spaces 4*a* face the first set of needles 6, as shown in FIG. 19. The drive-out spaces 4*a* are formed in the lamination 4 at the same pitches as the pitches of the pins 2 on the base 1 (not shown). By moving the lamination 4 to a predetermined position, therefore, the first set of needles 6 will be set facing the corresponding spaces 4*a*, easily and accurately. The first set of needles 6 is then simultaneously moved down, and inserted into the spaces 4*a* until the eyes 6*a* holding the vertical yarns s come out of the bottom of the lamination 4 (see FIG. 20). As a result, the vertical yarns z are inserted, each in a loop, into the lamination 4, where the removed pins 2 were located. Since the first set of needles 6 are placed into the spaces 4*a*, the first set of needles 6 will be inserted into the lamination 4 in slight contact therewith, and will not significantly damage the yarn lamination 4.

Then, as in the first embodiment, the selvage thread P is inserted, in a loop, through the loops L of the vertical yarns z. The first set of needles 6 is then lifted up out of the yarn lamination 4 to its original position. Then, the vertical yarns z are pulled by the action of the tension adjuster 7, so as to tighten the vertical yarns z, while the vertical yarns z are retained by the selvage thread P. Thereafter, the same process will be repeated and the pins 2 will be replaced, row by row, with the vertical yarns z, for yielding a reinforcing matrix.

In this embodiment, the first set of needles 6 are placed into the spaces 4*a*, to insert the vertical yarns z into the lamination 4, thus ensuring easier positioning of the first set of needles 6 at the respective inserting positions as compared with the case where the first set of needles 6 are inserted into the lamination 4 while driving out the pine 2. This prevents the vertical yarns z from being inaccurately inserted. Further, as the extraction of the pins 2 and the insertion of the first set of needles 6 are performed independently, the necessary working spaces can be secured without substantial restriction on the size and shape of the reinforcing matrix. Therefore, the replacement can easily be automated.

Third Embodiment

Figure 21:
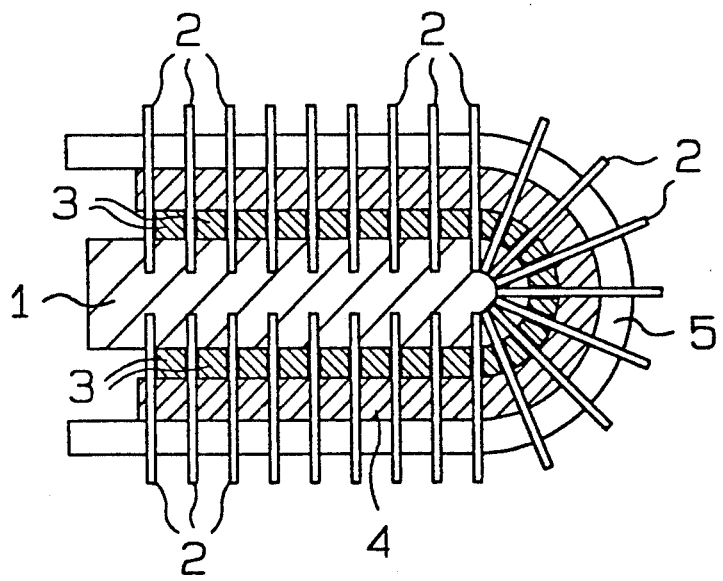
FIG. 21 is an exemplary cross section showing the relationship between a base, pins, support plates, and pressure plates according to a third embodiment of the present invention.
Figure 22:
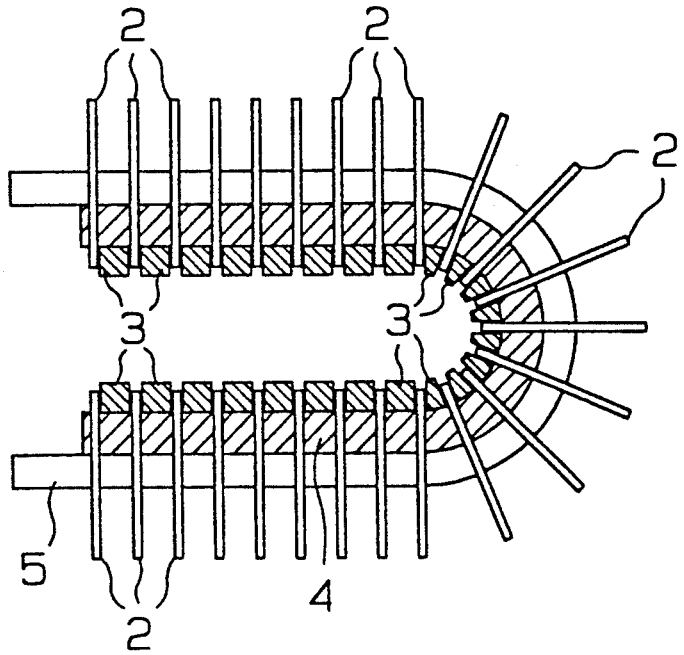
FIGS. 22 through 28 are exemplary cross sectional views illustrating the steps of replacing the pins with vertical yarns in the third embodiment.

A third embodiment will now be described referring to FIGS. 21 through 28. In this embodiment, a reinforcing matrix having a U-shaped cross section, rather than a flat reinforcing matrix, is produced. As shown in FIG. 21, the base 1 is formed thicker than those of the previous embodiments, with a first end portion having a semicircular shape. The ping 2 are removably inserted at predetermined pitches, on the top and bottom surfaces of the base 1 and on the arcuate surface which is integral with the top and bottom surfaces of the base 1. The support plates 3 are disposed between the pine 2 along the width direction of the base 1 (the vertical direction with respect to the plan of FIG. 21). As in the previous embodiments, the first and second bias yarns $B_1$ and $B_2$, the weft x, and the warp y, are arranged so as to weave between the pins 2, and to be repeatedly looped back and forth in engagement with those pins 2 which are located along the edges of the base 1.

After the individual yarn layers are laminated in the predetermined order on the base 1, to yield the lamination 4, with a U-shaped cross section, the pressure plates 5 are disposed at the outer surface of the lamination 4. The pressure plates 5, formed into a u shape, are placed between the pins 2, perpendicularly to the support plates 3. After the lamination 4 is compressed by the support plates 3 and pressure plates 5, the lamination 4 and the pans 2 are separated from the base 1 (see FIG. 22).

Next, the pins 2, still inserted in the lamination 4, are replaced with the vertical yarns z, and the yarn layers of the lamination 4 are interconnected by the vertical yarns z. In this embodiment too, the rows of the pins 2 that are arranged along the width direction of the base 1 are replaced, row by with the vertical yarns. The lamination 4 is supported perpendicularly to the moving direction of the first set of needles 6 by a supporting device (not shown) while being held by the support plates 3 and pressure plates 5. The supporting device is designed in such a way that, at the position where the flat portions of the lamination 4 face the first set of needles 6, this device can move the yarn lamination 4 in a direction perpendicular to the direction of arrangement of the first set of needles 6. At the position where the curved portion of the lamination 4 faces the first set of needles 6, the supporting device can rotate the yarn lamination 4 around an axis, which passes through the center of curvature of the curved portion, and which extends in the direction of arrangement of the first set of needles 6.

Figure 23:
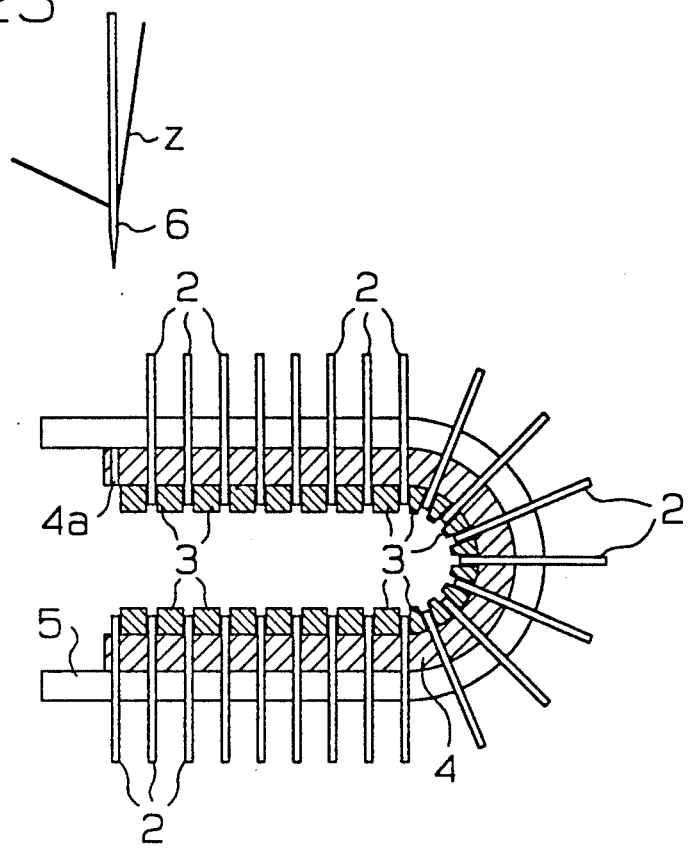
Figure 24:
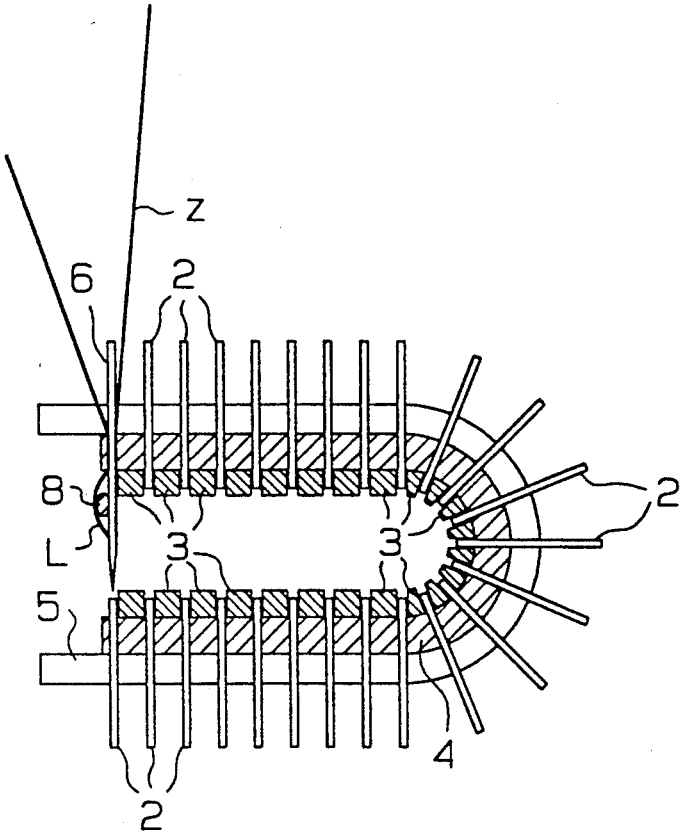
Figure 25:
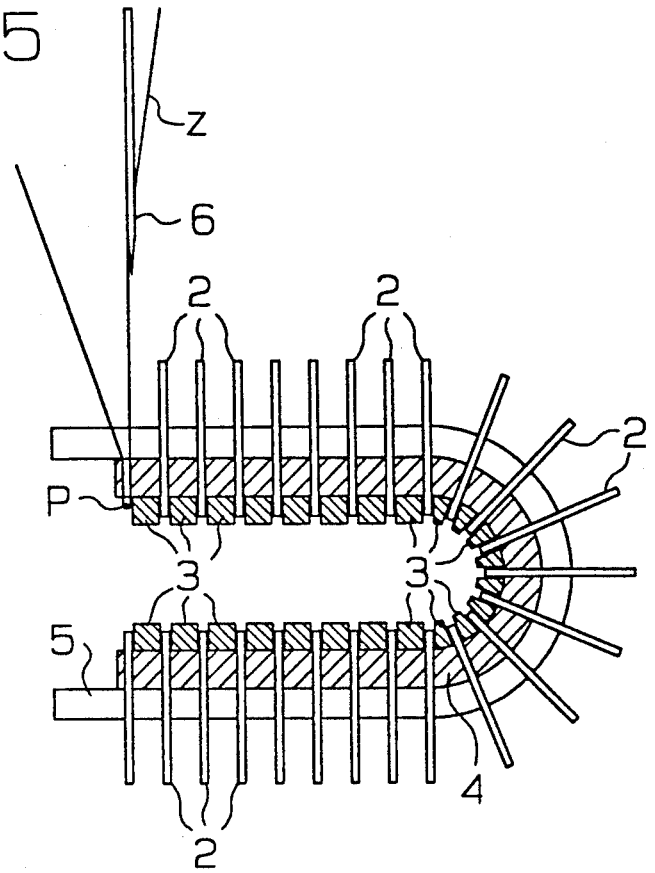

FIG. 23 illustrates the lamination 4 moved to the position where the first set of needles 6 face the spaces 4*a*, formed by the extraction of the first row of pins 2 from the lamination 4. The pin extraction from the lamination 4 is carried out at the position where a pin removing device (not shown) does not interfere with the first set of needles 6 and vertical yarns. The first set of needles 6 are simultaneously moved down, and are inserted into the spaces 4*a*, until the eyes (not shown) of the first set of needles 6 come out of the bottom of the yarn lamination 4 (see FIG. 24). AS a result, the vertical yarns z are inserted, each in a loop, into those portions of the lamination 4 where the pins 2 were located. Since the first set of needles 6 is placed into the spaces 4*a*, the first set of needles 6 will be inserted into the yarn lamination 4 in slight contact therewith, and will not significantly damage the yarn lamination 4.

Next, the second needle 8 is moved forward in the direction of arrangement of the first set of needles 6, and will stop when the tip of the second needle 8 passes through the loops L of the individual vertical yarns m held by the respective first set of needles 6, and reaches one end portion of the lamination 4. Then, the second needle 8 is pulled back so that the selvage thread P is inserted, in a loop, through the loops L of the vertical yarns z. Then, after the needles 6 are lifted out of the lamination 4 to their original positions, the vertical yarns z are pulled by the action of the tension adjuster 7 so as to tighten the vertical yarns z, while the vertical yarns z are retained by the selvage thread P. This completes the replacement of the first row of pins 2 with the vertical yarns z (see FIG. 15).

Figure 26:
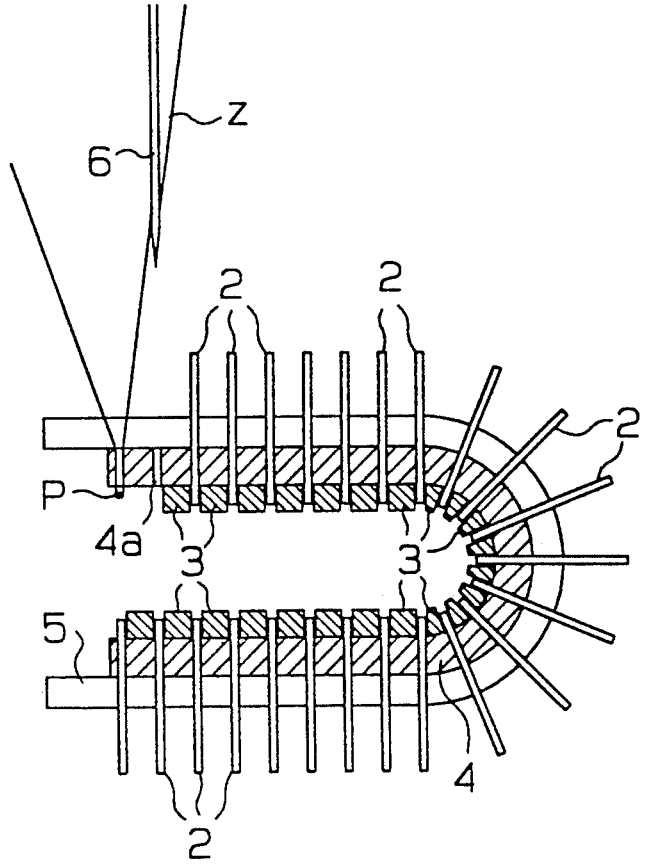
Figure 27:
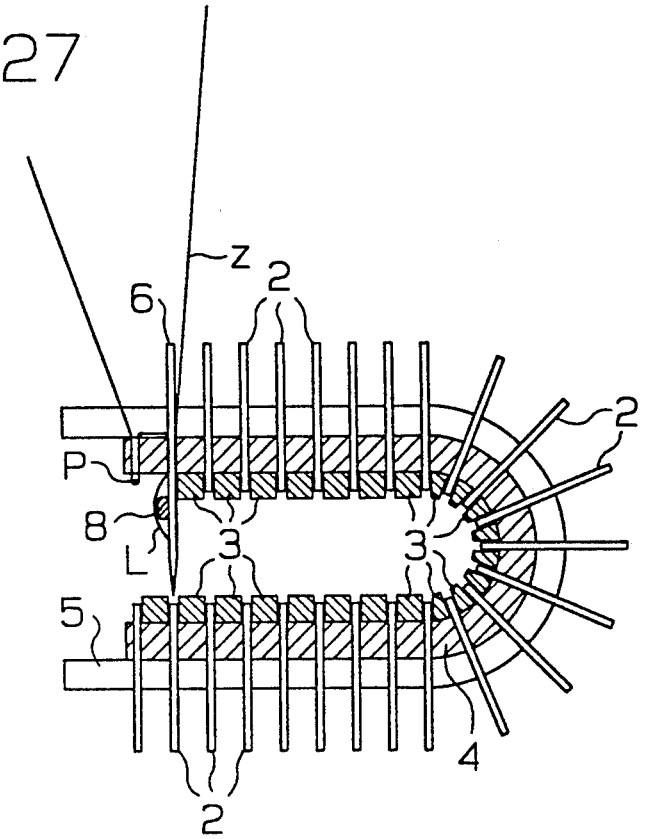
Figure 28:
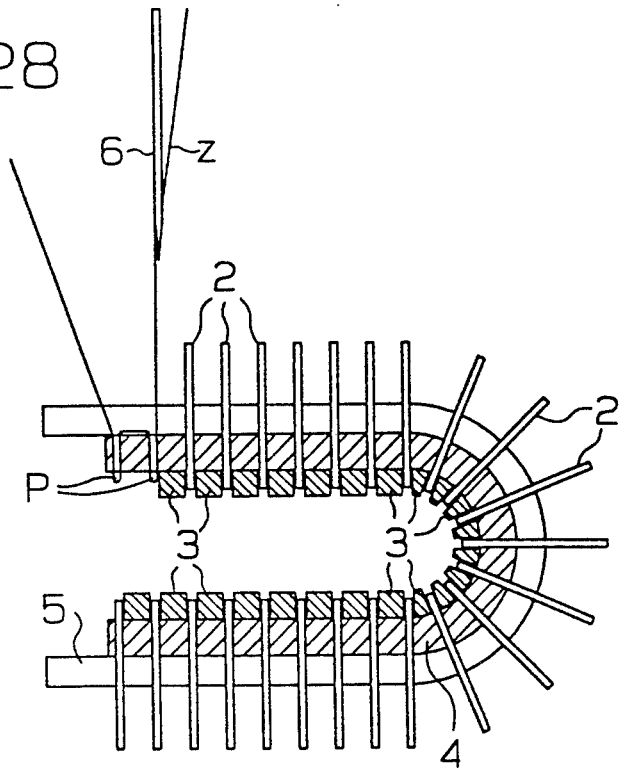
Figure 29:
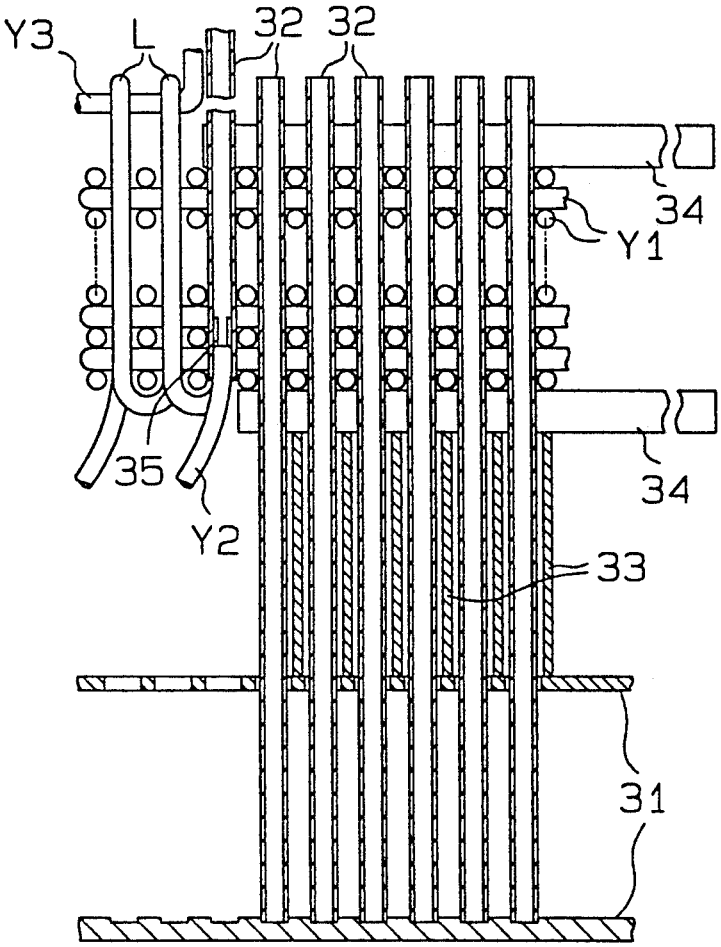
FIG. 29 (Prior Art)
FIG. 29 is an exemplary cross sectional view illustrating the step of replacing yarn guide pipes with lines of endless yarn according to the prior art.
Figure 30:
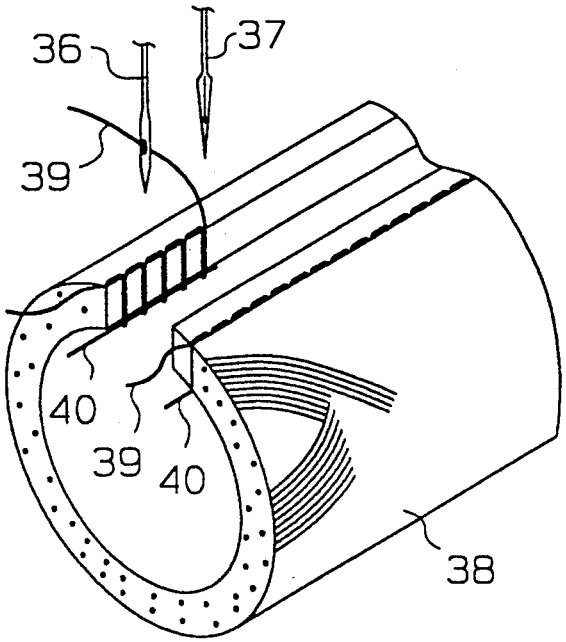
FIG. 30 (Prior Art)
FIG. 30 is a schematic perspective view showing another embodiment according to the prior art.

Then, after one support plate 3 is removed, the second row of pins 2 are pulled out, and the lamination 4 is moved to the position there the spaces &a face the first set of needles g (see FIG. 26). The needles 6 are then moved downward into the spaces 4*a*, and the second needle 8 is inserted through the loop portion (not shown) of the previous selvage thread P, and the loops L of the vertical yarns z, retained by the respective first set of needles 6 (see FIG. 27). After the selvage thread P, which is closer to the selvage-thread feeding section, is caught by the second needle 8, the second needle 8 is pulled back so that the selvage thread P is inserted through the loops L of the vertical yarns z.

The loop portion of the selvage thread P is held through the loop portion of the previous selvage thread P, similarly to the previous embodiments. After the loop portion of the previous selvage thread P is tightened, the needles 6 are lifted upwardly to their original positions. Then, the vertical yarns z, are tightened while being retained by the selvage thread P (see FIG. 28). Thereafter, the pins 2 are replaced in similar fashion, row by row, with the vertical yarns z, allowing the individual yarn layers of the lamination 4 to be interconnected with the vertical yarns z, for yielding a reinforcing matrix.

As the pins 2 are pulled out of the outer surface of the lamination 4, the resultant reinforcing matrix has a U shape with the two opposing faces, which will not hinder the pin extraction even if there is a small clearance between the opposing faces.

Although only three embodiments of the present invention have been described herein, it should be apparent to those skilled in the art that the present invention may be embodied in many other specific forms without departing from the spirit or scope of the invention. Particularly, it should be understood that this invention may be worked out in the following manners.

For instance, while the needles 6 have been described as being simultaneously inserted into the lamination 4, they could alternatively be separated into several groups such that they are inserted into the lamination 4 group by group. Alternatively, the needles 6 could be individually inserted, followed by the insertion of the vertical yarns s, the insertion of the selvage thread P, and the pulling of the vertical yarns z. Further, the regulating members or pins may be replaced, part by part, with the vertical yarns z using fewer needles 6 than regulating members (pins) arranged along the width direction. In this case, the pin extraction should be executed in synchronism with the timing of the insertion of the set of needles 6, for each pin targeted for the replacement.

Instead of the cylindrical pins 2, pipes or pins each having a recess at one end may be used as the regulating members. If pipes or pins each having a recess at one end are used in the first embodiment, the needles 6 would drive out the regulating members while in contact with the open ends of the pipes or the recesses of the pins, so that the needles 6 would securely engage the regulating members, thus ensuring smoother extraction.

Instead of repeating the insertion of the loop LP of the selvage thread P into the loop LP of the previous selvage thread P, the selvage thread P could Be retained by simply stretching the vertical yarns z.

The replacement of the regulating members with the vertical yarns z may be performed for each line of regulating members arranged along the longitudinal direction of the lamination 4, instead of each row of regulating members arranged along the width direction. In this case, the selvage thread P runs along the longitudinal direction of the lamination 4, and the vertical yarns z on the top surface of the lamination 4 are arranged along the width direction of the lamination 4.

The inclination angle of the bias yarns $B_1$ and $B_2$, which constitute the lamination 4, may be other than 45°. Instead of using both bias yarns $B_1$ and $B_2$, the lamination 4 may consist of two types of yarn, the weft x and warp y, to provide a reinforcing matrix, which has a three-axis three-dimensional fiber structure. Further, the bias yarns $B_1$ and $B_2$ that form a pair of bias-yarn layers may be arranged with an inclination angle of 60° with respect to the warp y, while no weft x is used, thereby providing a reinforcing matrix which has a four-axis three-dimensional fiber structure. Furthermore, the order of the arrangement of the weft x, the warp y and the bias yarns $B_1$ and $B_2$ may be set arbitrarily, and the proper resin impregnation and proper fabric forming technology may be selected to prevent the deformation of the reinforcing matrix after the resin impregnation or the fabric formation is performed. Instead of using each single line of weft x, warp y and bias yarns $B_1$ and $B_2$ to form the respective yarn layers, each yarn layer may be formed of a plurality of lines of yarns.

The shape of the reinforcing matrix is not limited to a flat shape or a U shape, but may take other forms, such as an L shape or a box shape. The latter reinforcing matrix can be produced in the same manner as the former reinforcing matrix, using many pins or pipes extending upwardly from the base having an L shape, a box shape or some other shape.

In the case where the needles 6 are inserted into the spaces 4*a*, the pins 2 may be extracted from the yarn lamination 4, from the opposite side, to the needle inserting side, if such action does not interfere with the replacement process.

In addition, the regulating members while retaining the vertical yarns z may be pulled out of the lamination 4, and at the same time, the vertical yarns z may be inserted into the lamination 4 without using the needles 6. One way to accomplish this is to pull out the pins each having an engaging portion at the tip, from the lamination 4, while the vertical yarns z are engaged with the engaging portions of the pine. Another way is to use pipes as regulating members, form a suction air stream at one end of each pipe to suck and hold the vertical yarn z held in the vicinity of the other end of the pipe, and pull out the pipes in this condition out of the lamination 4. In either case, each of the vertical yarns z is inserted, in a loop, into the lamination 4, so that the loops protrude from the lamination 4.

Therefore, the present examples and embodiments are to be considered as illustrative and not restrictive and the invention is not to be limited to the details given herein, but may be modified within the scope of the appended claims.

What is claimed is:

1. A method of producing a reinforcing matrix for a composite, comprising the steps of:

locating on a base a plurality of regulating members arranged in rows that extend in a first predetermined direction;

weaving yarns between said regulating members to form a lamination having a plurality of yarn layers on said base, said yarn layers having said yarns arranged in at least two different directions of said lamination;

simultaneously removing said lamination and said regulating members from said base;

collectively forming a plurality of loops corresponding to said plurality of regulating members by collectively replacing said regulating members with a plurality of vertical yarns, each of said vertical yarns forming one of said loops; and inserting a locking thread into said plurality of loops of said vertical yarns.

2. A method of producing a reinforcing matrix for a composite, comprising the steps of: locating on a base a plurality of regulating members arranged in rows that extend in a first predetermined direction; weaving yarns between said regulating members to form a lamination having a plurality of yarn layers on said base, said yarn layers having yarns arranged in at least two different directions of said lamination;

simultaneously removing said lamination and said regulating members from said base;

collectively forming a plurality of loops corresponding to said plurality of regulating members by collectively replacing said regulating members a row at a time with a corresponding row of vertical yarns, each of said vertical yarns forming one of said loops; and inserting a locking thread into said plurality of loops of said vertical yarns.

3. The method according to claim 1, wherein said lamination includes:

a first yarn layer including a first yarn arranged in a first plane, extending back and forth in parallel to a width direction of said lamination;

a second yarn layer including a second yarn arranged in a second plane, extending back and forth in parallel to a length direction of said lamination;

a first bias-yarn layer including a first bias yarn extending at an angle with respect to said length direction of said lamination; and a second bias-yarn layer including a second bias yarn that extends back and forth at an angle with respect to said first bias yarn, in mirror symmetry to said first bias yarn about the longitudinal axis of said yarn lamination.

4. The method according to claim 3, wherein said first bias yarn is woven at an angle of 45° with respect to said length direction of said lamination.

5. The method according to claim 3, wherein said yarn layers are woven symmetrically with respect to the plane passing through the center of said lamination, in the thickness direction.

6. A method of producing a reinforcing matrix, comprising the steps of:

locating on a base a plurality of regulating member arranged in rows that extend in a first predetermined direction;

weaving yarns between said regulating members to form a lamination having a plurality of yarn layers on said base, said yarn layers having said yarns arranged in at least two different directions of said lamination;

simultaneously removing said lamination and said regulating members from said base;

forming a plurality of drive-out spaces in said lamination corresponding to the number of said regulating members by removing said regulating members from the lamination;

securing a plurality of vertical yarns by means of yarn inserting members corresponding in number to the number of said regulating members arranged in a width direction of said lamination, and simultaneously inserting said yarn inserting members into said lamination through said drive-out spaces in such a way that yarn holding portions of said yarn inserting members come out of the lamination to form a plurality of loops of said vertical yarns; and inserting a locking thread into said loops held by said yarn holding portions along said yarn inserting member, and extracting said yarn inserting members from said lamination.

7. A method of producing a reinforcing matrix, comprising the steps of:

locating on a base a plurality of regulating members arranged in rows that extend in a first predetermined direction;

weaving yarns between said regulating members to form a lamination having a plurality of yarn layers on said base, said yarn layers having said yarns arranged in at least two different directions of said laminations;

simultaneously removing said lamination and said regulating members from said base;

removing said regulating members from said lamination, and inserting vertical yarns into spaces formed by the removal of said regulating members, such that each of said vertical yarns form a loop; and inserting a locking thread in a single pass through a plurality of said loops of said vertical yarns.

8. The method according to claim 7, wherein said step of inserting said vertical yarns includes the step of using yarn inserting members equal in number to the number of regulating members arranged along one row in a width direction of said lamination; sequentially removing said regulating members, row by row, from said lamination, to form corresponding spaces; and simultaneously inserting said yarn inserting members into said spaces.

9. The method according to claim 7, wherein a generally U-shaped lamination is formed, and said regulating members are pulled out of said lamination when said regulating members are removed therefrom.

* * * * *

UNITED STATES PATENT AND TRADEMARK OFFICE

CERTIFICATE OF CORRECTION

PATENT NO. : 5,327,621
DATED : July 12, 1994
INVENTOR(S) : Y. Yasui et al

It is certified that error appears in the above-indentified patent and that said Letters Patent is hereby corrected as shown below:

Column 2, line 6, after "repeated" insert --for--.

Column 3, line 2, change "at" to read --of--.

Column 6, line 12, "ping" should read --pins--; line 19, "planes" should read "plane;"; line 22, "pine" should read --pins--.

Column 7, line 3, delete "are still placed into", insert --remain in--; line 12, "pans" should read --pins--; line 44, "on" should read --of--; line 51, "lacking" should read —locking or—; line 52, delete "in a single pass"; line 66, after "inserted," insert --in a single pass,--.

Column 8, line 13, change "raw" to read --row--; line 67 "pans" should read --pins--; line 68, "Din" should read --pin--.

Column 9, line 10, "pine" should read --pins--; line 24, "s" should read --z--; line 48 "pine" should read --pins--; line 63 "ping" should read --pins--; line 67 "pine" should read --pins--.

Column 10, line 23, after "by" insert —row,—; line 45, after "yarns" and before the period insert --z--; line 59, change "m" to --z--.

UNITED STATES PATENT AND TRADEMARK OFFICE

CERTIFICATE OF CORRECTION

PATENT NO. : 5,327,621.

DATED : July 12, 1994

INVENTOR(S) : Y. Yasui et al

It is certified that error appears in the above-indentified patent and that said Letters Patent is hereby corrected as shown below:

Column 11, line 5 "&a" should read --4a--; line 6, "g" should read --6--; line 47, "s," should read --z,--.

Column 12, line 50, "pine." should read --pins.--

Column 13, line 17, start new line at "locating".

Column 14, line 1, "member" should read --members--.

Column 14, line 37, "laminations;" should read --lamination--.

Signed and Sealed this

Tenth Day of January, 1995

*Attest:*

*Attesting Officer*

BRUCE LEHMAN

*Commissioner of Patents and Trademarks*